US010260522B2

(12) United States Patent
Heeter et al.

(10) Patent No.: US 10,260,522 B2
(45) Date of Patent: Apr. 16, 2019

(54) LINER SYSTEM

(71) Applicant: Rolls-Royce Corporation, Indianapolis, IN (US)

(72) Inventors: Robert Warren Heeter, Noblesville, IN (US); Timothy John Unton, Avon, IN (US); Eric Engebretsen, Zionsville, IN (US); Jonathan Rivers, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 406 days.

(21) Appl. No.: 15/159,467

(22) Filed: May 19, 2016

(65) Prior Publication Data

US 2017/0335862 A1 Nov. 23, 2017

(51) Int. Cl.

| | |
|---|---|
| ***F01D 11/08*** | (2006.01) |
| ***F04D 29/52*** | (2006.01) |
| ***F04D 29/32*** | (2006.01) |
| ***F01D 21/04*** | (2006.01) |
| *F01D 25/24* | (2006.01) |

(52) U.S. Cl.

CPC ..... *F04D 29/526* (2013.01); *F01D 21/045* (2013.01); *F04D 29/325* (2013.01); *F01D 25/246* (2013.01); *F05D 2220/36* (2013.01)

(58) Field of Classification Search

CPC ..... F01D 11/122; F01D 11/08; F01D 21/045; F04D 29/526; F05D 2260/311

See application file for complete search history.

(56) References Cited

U.S. PATENT DOCUMENTS 4,295,787 A * 10/1981 Lardellier ..... F01D 11/122 415/173.6
4,648,795 A * 3/1987 Lardellier ..... F01D 21/045 415/173.4
5,267,828 A 12/1993 Lenhart et al.
(Continued)

FOREIGN PATENT DOCUMENTS

EP 2 952 695 A1 12/2015
GB 2 524 320 A 9/2015

OTHER PUBLICATIONS

European Office Action, dated Aug. 2, 2018, pp. 1-4, issued in European Patent Application No. 17 167 343.7, European Patent Office, Munich, Germany.

(Continued)

*Primary Examiner* — Ninh H. Nguyen
(74) *Attorney, Agent, or Firm* — Brinks Gilson & Lione

(57) ABSTRACT

The present disclosure provides a liner system for a turbine engine. The liner system includes a fan track liner panel that is positionable axially within a casing that is arranged around a rotatable fan and that forms a blade containment zone. The fan track liner panel is further positionable radially outward of the rotatable fan. The fan track liner panel includes a body that extends a length of the fan track liner panel from a fore portion of the fan track liner panel to an aft portion of the fan track liner panel. The fan track liner panel is configured to be directly secured to the casing by a fastener that extends through only part of the body and entirely through the casing within the blade containment zone such that the aft portion of the fan track liner panel abuts an interior surface of the casing.

21 Claims, 4 Drawing Sheets

(56) References Cited

U.S. PATENT DOCUMENTS

| | | | | |
|---|---|---|---|---|
| 6,382,905 | B1 | 5/2002 | Czachor et al. | |
| 7,866,939 | B2 | 1/2011 | Harper et al. | |
| 7,914,251 | B2 | 3/2011 | Pool et al. | |
| 8,028,802 | B2 | 10/2011 | Durchholz et al. | |
| 8,186,934 | B2 | 5/2012 | Humphries | |
| 8,231,328 | B2 | 7/2012 | Reed | |
| 8,591,172 | B2 | 11/2013 | Bottome | |
| 8,636,464 | B2 | 1/2014 | Bottome | |
| 8,672,609 | B2 * | 3/2014 | Lussier | F01D 21/045 415/197 |
| 2005/0271503 | A1 * | 12/2005 | Harper | F01D 21/045 415/170.1 |
| 2009/0277153 | A1 | 11/2009 | Harper et al. | |
| 2009/0324390 | A1 | 12/2009 | Harper et al. | |
| 2011/0076132 | A1 | 3/2011 | Kristofer | |
| 2012/0224949 | A1 | 9/2012 | Harper et al. | |
| 2013/0189095 | A1 | 7/2013 | Harper et al. | |
| 2015/0023780 | A1 | 1/2015 | Costa et al. | |
| 2015/0292407 | A1 | 10/2015 | Riou et al. | |

OTHER PUBLICATIONS

European Search Report, European Patent Application No. 17167343, dated Oct. 6, 2017, pp. 2, European Patent Office, Munich, Germany.

European Search Opinion, European Patent Application No. 17167343, dated Oct. 6, 2017, pp. 5, European Patent Office, Munich, Germany.

* cited by examiner

LINER SYSTEM

FIELD

The present disclosure relates generally to a liner system for a turbine engine, and more particularly, to a fan track liner panel for mounting to a casing of such an engine.

BACKGROUND

The statements in this section merely provide background information related to the present disclosure and may not constitute prior art.

Turbine engines for powering aircraft conventionally include an engine, which drives a fan. The fan includes a number of radially extending fan blades mounted on a fan rotor enclosed by a generally cylindrical fan casing.

Although rare, a fan blade off event can occur, for example due to a foreign body, such as a bird, striking a fan blade and resulting in at least part of a fan blade becoming detached. Accordingly, the casing around the fan is designed to withstand the high energies caused by an impact of the detached portion of a fan blade.

Conventionally, a fan track liner made up of a number of panels is provided within the casing around and adjacent the tips of the fan blades. The fan track liner panels can be designed to be cut or rubbed away by the blade tips.

SUMMARY

The present disclosure provides a liner system for a turbine engine. The liner system includes a fan track liner panel that is positionable axially within a casing that is arranged around a rotatable fan and that forms a blade containment zone. The fan track liner panel is further positionable radially outward of the rotatable fan. The fan track liner panel includes a body that extends a length of the fan track liner panel from a fore portion of the fan track liner panel to an aft portion of the fan track liner panel. The fan track liner panel is configured to be directly secured to the casing by a fastener that extends through only part of the body and entirely through the casing within the blade containment zone such that the aft portion of the fan track liner panel abuts an interior surface of the casing while the fore portion of the fan track liner panel extends away from the casing thereby defining a cavity between the interior surface of the casing and a surface of the fore portion of the fan track liner panel.

According to another form of the present disclosure, the liner system includes a fan track liner panel that is positionable axially within a casing that is arranged around a rotatable fan and that forms a blade containment zone. The fan track liner panel is further positionable radially outward of the rotatable fan. Here, the fan track liner panel includes a first body and a second body separated by a seam. The first body and the second body are layered between a first surface and a second surface. The first surface is configured to face away from the casing and the second surface is configured to face toward the casing. The second surface includes a first portion along the first body and a second portion along the second body. The first body is configured to be secured to the casing by a fastener extending through the casing in the blade containment zone such that the first portion of the second surface is contiguously aligned with the casing in parallel with a surface of the casing, and the second body is configured to project away from the casing toward the rotatable fan to form a cavity between the second portion of the second surface and the surface of the casing. The use of the terms "first" and "second" to differentiate the portions of the body are for purposes of explanation only and should not be construed by the reader as limiting in any way.

Yet another form of the present disclosure provides a fan track liner system that includes a fan track liner panel that is positionable axially within a casing that is arranged around a rotatable fan and that forms a blade containment zone. The fan track liner panel is further positionable radially outward of the rotatable fan. This fan track liner panel includes a body layered between a first surface and a second surface. The first surface is configured to face away from the casing and the second surface is configured to face toward the casing. A seam is positioned between a first end of the fan track liner panel and a second end of the fan track liner panel. The seam extends through the body from the first surface to the second surface. The fan track liner panel is configured to be secured to the casing by a fastener extending through the casing in the blade containment zone such that a portion of the second surface between the seam and the second end of the fan track liner panel is in continuous contact with a surface of the casing.

Providing a liner system configured to be mechanically fastened directly to the casing eliminates the need to manufacture integral hooks or other coupling mechanisms from which a panel may be suspended thereby minimizing/eliminating design complexity, manufacturing time, manufacturing cost of the casing, and adding weight to the turbine engine. This reduces the casing manufacturing time and weight. Bolting the liner system directly to the casing also eliminates the need to adhesively bond the liner panels to the casing, thereby reducing the risk of damaging the casing when performing what can be a difficult and time consuming removal of a liner panel, and allowing the casing wall to be thinner, which reduces the cost and weight of the casing. In the disclosed system, the robustness of the fan track liner panel is improved since at least a portion of the panel is fully supported or backed by the casing. Additionally, the time required to replace a liner system that is bolted through the casing is greatly reduced.

These and other features and advantages of this disclosure will become apparent upon reading the following specification, which, along with the drawings, describes preferred and alternative embodiments of the disclosure in detail.

DRAWINGS

This disclosure will be further described, by way of example, with reference to the accompanying drawings in which.

Although the drawings represent embodiments of the present disclosure, the drawings are not necessarily to scale and certain features may be exaggerated in order to illustrate and explain the present disclosure. The examples set forth herein are not to be construed as limiting the scope of the disclosure in any manner.

DETAILED DESCRIPTION

Figure 1:
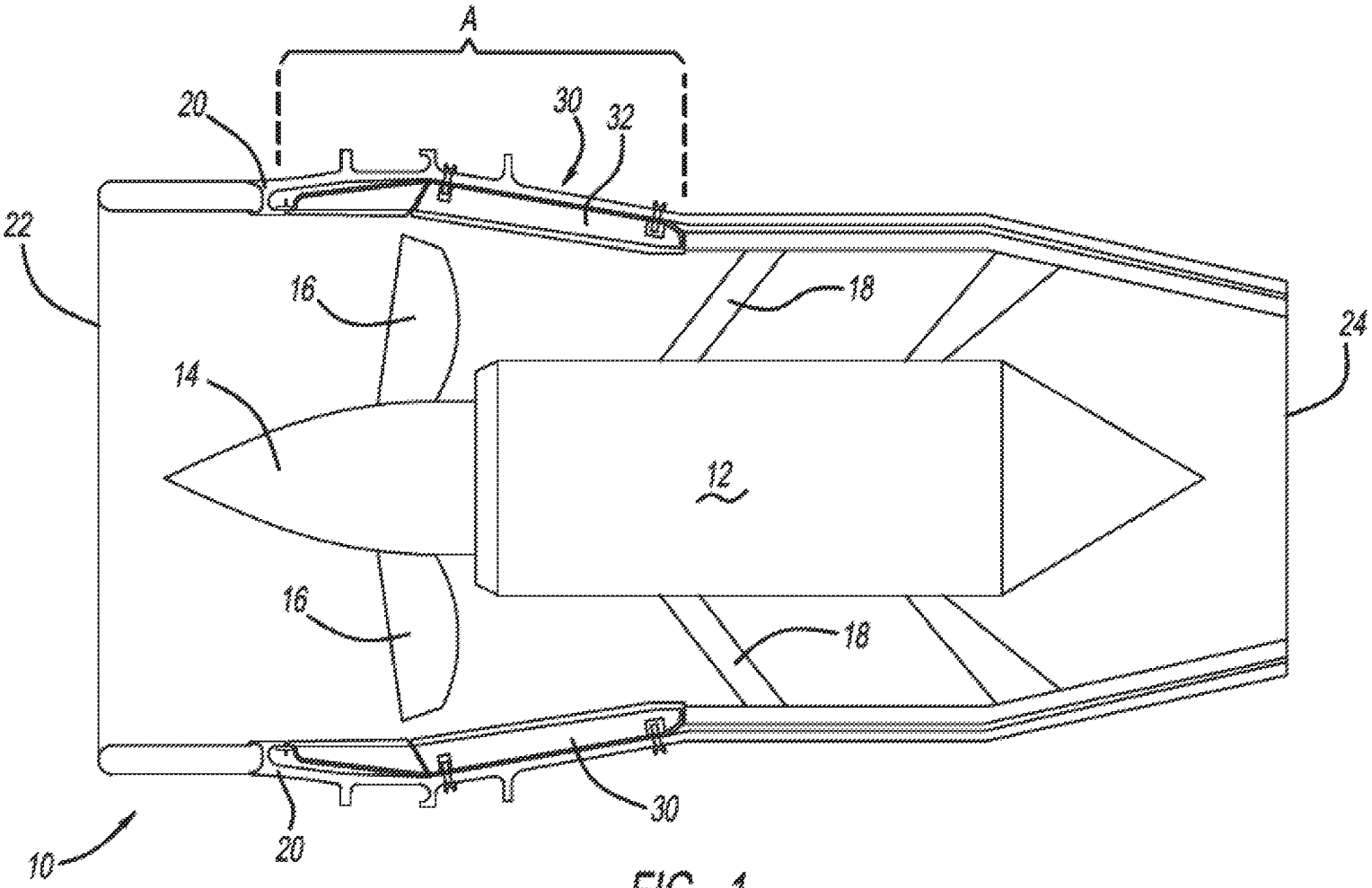
FIG. 1 is a partially cut away view of an example of a turbine engine having a liner system according to the present disclosure.

An example of a turbine engine 10, such as a gas turbine engine, as shown in FIG. 1, includes a core 12 which drives a rotary fan 14 having a plurality of circumferentially spaced fan blades 16 thereabout. The core 12 is mounted by struts 18 to a casing 20. The casing 20 is arranged around the core 12 and the fan blades 16. The casing 20 forms a containment zone A as indicated in an area around and near the fan blades 16. The casing 20 is formed of a high strength ductile material and the containment zone A is particularly suited to withstand the high energies caused by an impact of a detached portion of a fan blade during a blade off event. The casing 20 has an inlet 22 and an exhaust nozzle 24 and forms a duct around the fan 14. In use, air is drawn in via the inlet 22 and compressed by the fan 14. Some of the compressed air is fed into the core 12 which includes further compressor stages, a combustor, and a turbine which drives the fan 14. The rest of the air, so called bypass air, is directed around the core 12 to the exhaust nozzle 24. Thrust is provided by both the exhaust from the core 12 and the bypass air from the fan 14. In other examples, other forms of turbine engines, such as a combustion turbine in the form of a turbojet, a turbofan, a turboprop, an afterburning turbojet, or any other form of rotational propulsion system having fan blades may be depicted.

The turbine engine 10 of FIG. 1 includes a liner system 30 according to the present disclosure. The liner system 30 includes a fan track liner panel 32 that is positionable axially within a casing 20 and radially outward of the rotatable fan 14 and fan blades 16. The liner system 30 includes a plurality of fan track liner panels 32 which are arranged circumferentially and axially along an inner surface 21 of the casing 20. The plurality of fan track liner panels 32 cooperate with each other during use to form a continuous barrier within the containment zone A between the fan blades 16 and the casing 20.

Figure 2:
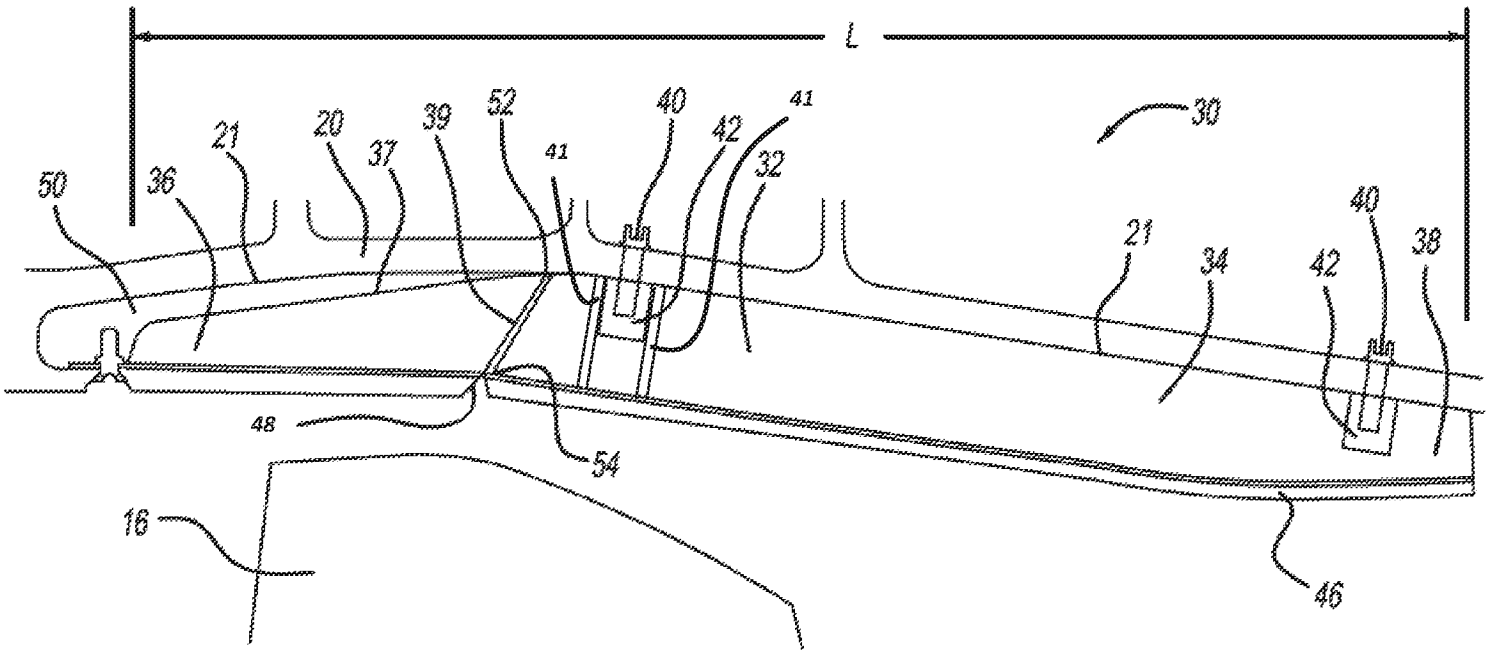
FIG. 2 is an enlarged cross-sectional view of an example of the liner system shown in FIG. 1.
Figure 3:
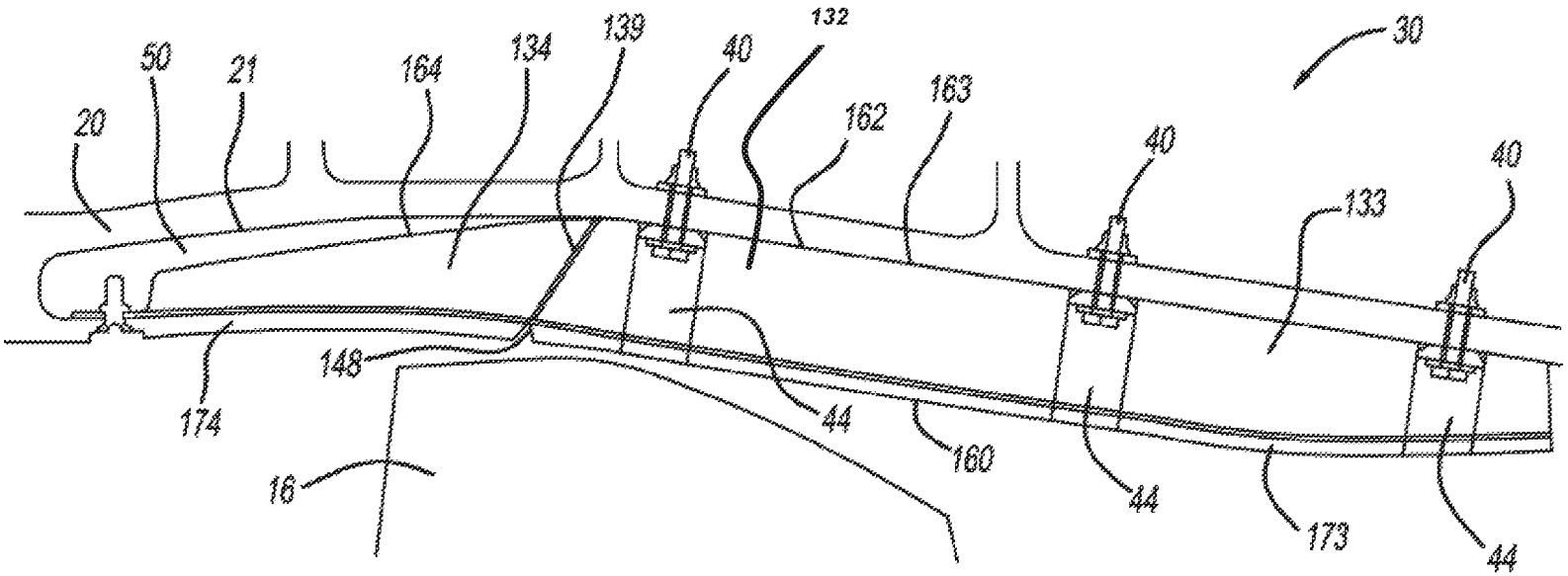
FIG. 3 is an enlarged cross-sectional view of an example of a liner system according to another form of the present disclosure.
Figure 4:
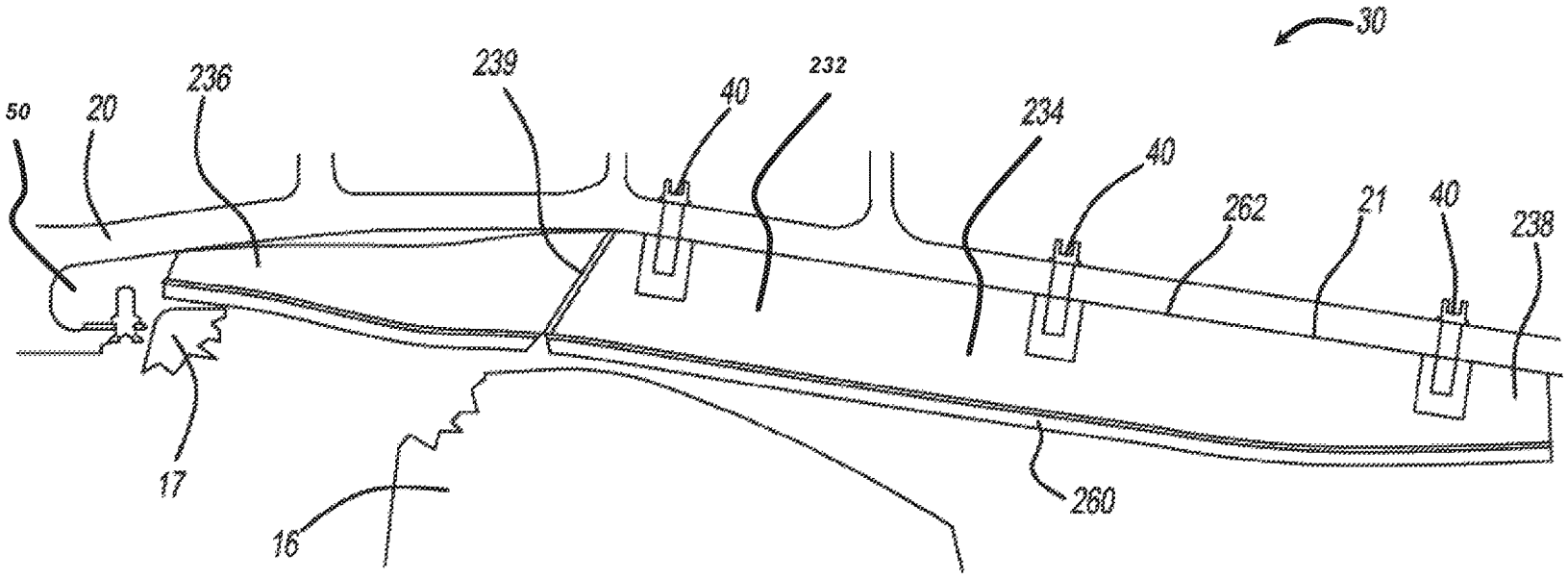
FIG. 4 is an enlarged cross-sectional view of an example of a liner system according to the present disclosure during a blade off event.

FIGS. 2, 3, and 4 each show an enlarged cross-sectional view of the containment zone A of FIG. 1 and the liner system 30 according to varying forms of the present disclosure. The fan track liner panel 32 shown in FIG. 2 includes a body 34 that extends a length L of the fan track liner panel 32 from a fore portion 36 of the fan track liner panel to an aft portion 38 of the fan track liner panel 32. The fore portion 36 is configured to be collapsible to function during a blade off event, while the aft portion 38 is configured to have compressive strength in order to withstand impacts during operation. The fan track liner panel 32 is configured to be directly secured to the casing 20 by a fastener 40 that extends through at least part of the body 34 and entirely through the casing 20 within the blade containment zone A such that the aft portion 38 of the fan track liner panel 32 abuts an interior surface 21 of the casing 20 while the fore portion 36 of the fan track liner panel 32 extends away from the casing 20 thereby defining a cavity 50 between the interior surface 21 of the casing 20 and a surface 37 of the fore portion 36 of the fan track liner panel 32. When the fan track liner panel 32 is installed in the casing 20, the fore portion 36 of the liner panel 32 is positioned toward the casing inlet 22 upstream of the aft portion 38 that is positioned toward the exhaust nozzle 24.

The fan track liner panel 32 further includes an abradable layer 46. The abradable layer 46 is layered along the body 34 and extends the length L of the fan track liner panel 32. That is, the abradable layer 46 extends from the fore portion 36 to the aft portion 38 of the fan track liner panel 32. Alternatively, the abradable layer 46 may extend along only a portion of the length L of the fan track liner panel 32. The abradable layer 46 is designed to be cut or rubbed away by the tips of the fan blades 16. Providing such an abradable layer 46 allows the fan blades 16 to cut a track in the fan track liner panels 32, thereby minimizing gaps between the fan blades 16 and the inner surface 21 of the casing 20 and minimizing air leakage around the tips of the blades 16. The abradable layer 46 also allows the fan blades 16 to cut into the fan track liner panel 32 when the blades 16 become elongated due to centrifugal forces resulting from the rotation of the fan 14.

The body 34 may be formed of a lightweight, stiff material such as foam, phenolic honeycomb, or an aluminum honeycomb. As shown in FIG. 2, the body 34 includes a seam 39. In other examples, the seam can be multiple cooperatively operating seams 39.

The seam 39 divides the fore portion 36 and the aft portion 38 of the fan track liner panel 32. The seam 39 is configured to act as a mechanical fuse that is designed to fail or separate so the fore portion 36 can move independently from the aft portion 38 during a blade off event, as shown in FIG. 4. A first end 52 of the seam 39 of the fan track liner panel 32 is configured to, and in FIG. 2 does, abut the interior surface 21 of the casing 20. Dividing the fore portion 36 and the aft portion 38 such that the first end 52 of the seam 39 is backed up to the casing 20 allows the height of the fore portion 36 to be maximized. The first end 52 of the seam 39 can act as a pivot point when the fan track liner panel 32 is struck with an object, such as a detached fan blade or fan blade fragment 17 during a blade off event, as shown in FIG. 4. Positioning the first end 52 of the seam 39 directly against the casing 20 improves the movement and dynamic response of the fore portion 36 during a blade off event due to the similarity in thickness and stiffness of the body 34 on both sides of the seam 39.

The seam 39 can be formed to extend substantially perpendicularly from the interior surface 21 of the casing 20. Substantially perpendicularly meaning within +/−5 degrees from perpendicular. Alternatively, the seam 39 may be positioned between 5 and 35 degrees from perpendicular to the casing. A second end 54 of the seam 39 aligns with a notch 48 in the abradable layer 46. The notch 48 in the abradable layer 46 can act as a separation point when, for example, the fan track liner panel 32 is struck with a detached fan blade fragment 17 during a blade off event, as shown in FIG. 4. The seam 39 can be positioned directly upstream of the fastener 40. The first end 52 of the seam may start at the point through which the fastener 40 passes, or may be spaced apart from the fastener 40 a predetermined distance, for example up to 3.8 to 4 centimeters from the centerline of the fastener opening, toward the fore portion 36. An area around the fastener 40 may be reinforced with a supportive material 41 to increase stiffness of the fan track liner panel 32 near the seam 39 in comparison to other areas of the fan track panel.

The fastener 40 may be a plurality of fasteners spaced along a length of the aft portion 38 of the fan track liner panel 32 such that the aft portion 38 abuts and is supported by the interior surface 21 of the casing 20. Alternatively, the fastener 40 extending through the casing 20 in the blade containment zone A can be located at the front of the aft portion 38 proximate the seam 39 while the fore portion 36 and the back of the aft portion 38 are indirectly attached to the casing 20, for example by coupling or fastening to hooks that extend from the casing 20, such that the aft portion 38 abuts and is supported by the interior surface 21 of the casing 20. The fastener 40 may be a nut and bolt combination. The nut may be a threaded nut or a captive nut. The fastener 40 passes through the casing 20 within the blade containment zone A, which in the past has been avoided due to the risk of the casing 20 cracking around the fastener holes upon impact of a detached portion of a fan blade. The ductile material of the casing 20 along with the impact absorption of the body 34 of the liner system 30 of the present disclosure reduces the risk of cracks forming in the casing 20.

As shown in FIG. 2, the nut can be embedded in the body 34 as a potted insert 42. Here, the fastener 40, a bolt, is inserted into and through the casing 20 from outside of the casing 20, or an "out-to-in" configuration. The fastener 40 extends entirely through the thickness of the casing 20 wall into the potted insert 42 embedded in the body 34. In this way, the fastener 40 extends only partly through the body 34. The fastener 40 secures the aft portion 38 of the fan track liner panel 32 to the casing 20 such that the aft portion 38 abuts the interior surface 21 of the casing. Alternatively, as shown in FIG. 3, the fastener 40 may be inserted through a cavity 44 defined in the body 34 that is configured to receive the fastener 40 or bolt. Once inserted through the cavity 44, the fastener 40 is passed through or into the casing 20 from inside to outside of the casing 20, as an "in-to-out" configuration. Here, a nut is coupled to the bolt to secure the aft portion 38 of the fan track liner panel 32 directly to the casing 20. In this way, the fastener 40 extends entirely through the wall of the casing 20 and partly through the body 34. Alternatively, the hole formed in the casing 20 that receives the fastener 40 may be threaded or include a threaded insert into which the fastener 40 may be threaded after being passed through the body 34.

As shown in FIG. 2, the fore portion 36 of the fan track liner panel 32 defines a containment cavity 50 between the interior surface 21 of the casing 20 and a surface 37 of the fore portion 36 of the fan track liner panel 32. The containment cavity 50 is configured to receive and contain and object, such as a detached fan blade fragment 17 during a blade off event.

FIG. 4 shows an example of operation of the fan track liner panel 32 during a blade off event. The various embodiments discussed in the present disclosure can exhibit the same functionality. When an object, such as a detached fan blade fragment 17 strikes the fore portion 36 of the fan track liner panel 32 of FIG. 2, the seam 39 acts as a mechanical fuse, failing or separating in a predesigned and controlled fashion. The fore portion 36 pivots at the first end 52 of the seam 39 as the second end 24 of the seam or the notch 48 separates. The pivoting motion allows the fore portion 36 of the fan track liner panel 32 to move into the containment cavity 50, thereby making a path for the detached fan blade fragment 17 to enter the containment cavity 50. The detached fan blade fragment 17 may then be trapped behind the fore portion 36 to prevent the detached fan blade fragment 17 from damaging the rest of the turbine engine 10.

Referring now to FIG. 3, an example of a liner system 30 according to another form of the present disclosure is provided. The fan track liner panel 132 shown in FIG. 3 includes a first body 133 and a second body 134. The first and second bodies 133, 134 are separated by a seam 139. The first body 133 and the second body 134 are layered between a first surface 160 and a second surface 162. The first surface 160 is positioned to face away from the casing 20 and the second surface 162 positioned to face toward the casing 20. The second surface 162 includes a first portion 163 along the first body 133 and a second portion 164 along the second body 134. The first body 133 is secured to the casing by a fastener 40 extending through the casing 20 in the blade containment zone A such that the first portion 163 of the second surface 162 is contiguously aligned with the casing 20 in parallel with a surface 21 of the casing 20, and the second body 134 projects away from the casing 20 toward the rotatable fan 14 and fan blades 16 to form a cavity 50 between the second portion 164 of the second surface 162 and the surface 21 of the casing 20.

As discussed elsewhere, the bodies 133, 134 may be formed of a rigid, material such as foam, phenolic honeycomb, or an aluminum honeycomb. The first body 133 and the second body 134 may be formed from a continuous piece of material and therefore the first and second bodies 133, 134 are designated as such for clarity, or the first and second bodies 133, 134 may be formed of two distinct pieces of material. In another example, the two bodies 133, 134 may be formed of entirely different materials.

Additionally, as discussed elsewhere, the fastener 40 may be a nut and bolt combination or any other suitable fastener known in the art. The bolt may be passed from the outside of the casing 20 to the inside of the casing 20 to be coupled with either a free nut or a nut embedded in the first body 133 as a potted inset. Alternatively, the fastener 40 may be passed through a cavity 44 defined in the first body 133 from inside the casing 20 through to the outside of the casing 20 where the fastener 40 may be coupled with a nut, a captive nut, a rivetless nutplate, a swage nut, or other suitable securing device. Alternatively, as discussed elsewhere, the fastener 40 may be coupled with a threaded insert in the casing 20.

The first surface 160 may be an abradable material. Alternatively, the abradable material may be layered onto the first surface 160 to create an additional layer between the bodies 133, 134 and the fan blades 16. As discussed elsewhere, the abradable material is a layer designed to be cut or rubbed away by the fan blades 16. The abradable material may be added to the fan track liner panel 132 after the fan track liner panel 132 is installed into its position within the casing 20, such as, for example, when the fasteners 40 are inserted through the fan track liner panel 132 and the casing 20 from inside the casing 20 in an "in-to-out" configuration due to the need for the cavities 44 to be uncovered to receive the fasteners 40. After installation of the fan track liner panel 132, the abradable layer may be added or installed. Additionally, a filler material may be added to take up volume behind the abradable layer.

The first surface 160 includes a first portion 173 and a second portion 174. The first portion extends along the first body 133 and the second portion 174 extends along the second body 134. A notch 148 separates the first and second portions 173, 174 of the first surface 160. As shown in FIG. 3, the notch 148 is aligned with the seam 139.

The seam 139 is configured to be positioned substantially perpendicularly to the surface 21 of the casing 20 and can be immediately adjacent to the fastener 40 in the first body 133 that is closest to the second body 134.

The seam 139 is configured to act as a mechanical fuse and the notch 148 is configured to act as a separation point when the second portion 174 of the first surface 160 is struck by and object, such as a detached fan blade fragment 17 during a blade off event, as shown in FIG. 4. When the detached fan blade fragment 17 comes in contact with the second portion 174 of the first surface 160, the force exerted by the fragment 17 causes the second body 134 to move toward the casing 20, thereby allowing the cavity 150 to accept the detached fan blade fragment 17.

Referring again to FIG. 4, yet another form of the present disclosure provides a fan track liner panel 232 that includes a body 234 layered between a first surface 260 and a second surface 262. The first surface 260 is configured to face away from the casing 20 and the second surface 262 is configured to face toward the casing 20. A seam 239 is positioned between a first end 236 of the fan track liner panel 232 and a second end 238 of the fan track liner panel 232. The seam 239 extends through the body 232 from the first surface 260 to the second surface 262. The fan track liner panel 232 is configured to be secured to the casing 20, such as by a fastener 40 extending through the casing 20 in the blade containment zone A such that a portion of the second surface 262 between the seam 239 and the second end 238 of the fan track liner panel 232 is in continuous contact with a surface 21 of the casing 20.

As discussed elsewhere, the body 234 may be formed of a lightweight, stiff material such as foam, phenolic honeycomb, or an aluminum honeycomb. The body 234 may be formed of a continuous piece of material or may be formed of multiple pieces of material.

Additionally, as discussed throughout the present disclosure, the fastener 40 may be a nut and bolt combination or any other suitable fastener known in the art. The bolt may be passed from the outside of the casing 20 to the inside of the casing 20 to be coupled with either a free nut or a nut embedded in the first body 133 as a potted inset. Alternatively, the fastener 40 may be passed through a cavity 44 (shown in FIG. 3) defined in the body 234 from inside the casing 20 through to the outside of the casing 20 where the fastener 40 may be coupled with a nut or other suitable securing device.

The first surface 260 may be an abradable material or layer. As discussed above, the abradable material is a layer designed to be cut or rubbed away by the fan blades 16. The abradable material may be added to the fan track liner panel 232 after the fan track liner panel 232 is installed into its position within the casing 20, or may be included on the fan track panel 232.

It is to be understood that the invention has been described with reference to specific embodiments and variations to provide the features and advantages previously described and that the embodiments are susceptible of modification as will be apparent to those skilled in the art.

What is claimed is:

1. A liner system comprising:

a fan track liner panel positionable axially within a casing arranged around a rotatable fan and forming a blade containment zone, the fan track liner panel positionable radially outward of the rotatable fan;

the fan track liner panel comprising:

a body extending a length of the fan track liner panel from a fore portion of the fan track liner panel to an aft portion of the fan track liner panel, the fore portion divided from the aft portion by a seam in the body, the seam configured to act as a mechanical fuse; and wherein the fan track liner panel is configured to be directly secured to the casing by a fastener extending through only part of the body and at least partially through the casing within the blade containment zone such that the aft portion of the fan track liner panel abuts an interior surface of the casing, and the fore portion of the fan track liner panel extends away from the casing to define a cavity between the interior surface of the casing and a surface of the fore portion of the fan track liner panel.

2. The liner system of claim 1, wherein the fastener is a plurality of fasteners spaced apart along a length of only the aft portion of the fan track liner panel.

3. The liner system of claim 1, wherein the fastener is a bolt used in conjunction with a nut.

4. The liner system of claim 3, wherein the nut is embedded in the body of the fan track liner panel as a potted insert.

5. The liner system of claim 3, wherein the body defines a body cavity configured to receive the bolt.

6. The liner system of claim 1, further comprising an abradable layer layered along a surface of the body extending the length of the fan track liner panel from the fore portion to the aft portion of the fan track liner panel.

7. The liner system of claim 1, further comprising an abradable layer layered along a surface of the body extending along the length of the fan track liner panel, the abradable layer defining a notch, wherein the notch aligns with a second end of the seam, and wherein the notch is configured to act as a separation point.

8. The liner system of claim 1, wherein the seam is configured to be positioned directly upstream of the fastener.

9. The liner system of claim 1, wherein the cavity is configured to receive a detached fan blade fragment.

10. The liner system of claim 1, wherein the seam is configured to enable the fore portion to move independent of the aft portion during a blade off event.

11. The liner system of claim 10, wherein a first end of the seam is configured to abut the interior surface of the casing, and wherein the first end of the seam is configured to act as a first pivot point during the blade off event.

12. The liner system of claim 10, wherein the seam is configured to extend substantially perpendicularly from the interior surface of the casing to a second end of the seam, the second end configured to separate during the blade off event.

13. A liner system comprising:

a fan track liner panel positionable axially within a casing arranged around a rotatable fan and forming a blade containment zone, the fan track liner panel positionable radially outward of the rotatable fan;

the fan track liner panel comprising:

a first body and a second body separated by a seam, the first body and the second body layered between a first surface and a second surface, the first surface configured to face away from the casing and the second surface configured to face toward the casing, the second surface including a first portion along the first body and a second portion along the second body;

wherein the first body is configured to be secured to the casing by a fastener extending through the casing in the blade containment zone such that the first portion of the second surface is contiguously aligned with the casing in parallel with a surface of the casing; and wherein the second body is configured to project away from the casing toward the rotatable fan to form a cavity between the second portion of the second surface and the surface of the casing.

14. The liner system of claim 13, wherein the first surface is an abradable material.

15. The liner system of claim 13, wherein the first surface includes a first portion along the first body and a second portion along the second body, and wherein the first and second portions of the first surface are separated by a notch on the first surface.

16. The liner system of claim 15, wherein the notch is aligned with the seam.

17. The liner system of claim 15, wherein the seam is configured to act as a mechanical fuse and the notch is configured to act as a separation point when the second portion of the first surface is struck by a detached fan blade fragment, such that the second body moves toward the casing to accept the detached fan blade fragment.

18. The liner system of claim 13, wherein the seam is configured to be positioned substantially perpendicularly to the surface of the casing.

19. The liner system of claim 13, wherein the seam is configured to be immediately adjacent to the fastener.

20. A liner system comprising:

a fan track liner panel positionable axially within a casing arranged around a rotatable fan and forming a blade containment zone, the fan track liner panel positionable radially outward of the rotatable fan;

the fan track liner panel comprising:

a body layered between a first surface and a second surface, the first surface configured to face away from the casing and the second surface configured to face toward the casing; and a seam positioned between a first end of the fan track liner panel and a second end of the fan track liner panel, the seam extending through the body from the first surface to the second surface;

wherein the fan track liner panel is configured to be secured to the casing by a fastener extending through the casing in the blade containment zone, such that a portion of the second surface between the seam and the second end of the fan track liner panel is in continuous contact with a surface of the casing.

21. A liner system comprising:

a fan track liner panel positionable axially within a casing arranged around a rotatable fan and forming a blade containment zone, the fan track liner panel positionable radially outward of the rotatable fan;

the fan track liner panel comprising:

a body extending a length of the fan track liner panel from a fore portion of the fan track liner panel to an aft portion of the fan track liner panel, the fore portion divided from the aft portion by a seam in the body, the seam configured as a mechanical fuse to enable the fore portion to move independent of the aft portion during a blade off event; and wherein the fan track liner panel is configured to be secured to the casing within the blade containment zone such that the aft portion of the fan track liner panel abuts an interior surface of the casing, and the fore portion of the fan track liner panel extends away from the casing to define a cavity between the interior surface of the casing and a surface of the fore portion of the fan track liner panel, the fore portion pivotably movable independent of the aft portion, into the cavity, during the blade off event.

* * * * *